US005552076A

United States Patent [19]

Gamota et al.

[11] Patent Number: 5,552,076

[45] Date of Patent: Sep. 3, 1996

[54] ANHYDROUS AMORPHOUS CERAMICS AS THE PARTICULATE PHASE IN ELECTRORHEOLOGICAL FLUIDS

[75] Inventors: Daniel R. Gamota, Palatine, Ill.; Brian L. Mueller, Utica; Frank E. Filisko, Ann Arbor, both of Mich.

[73] Assignee: The Regents of the University of Michigan, Ann Arbor, Mich.

[21] Appl. No.: 257,319

[22] Filed: Jun. 8, 1994

[51] Int. Cl.[6] ..... H01B 3/20; C09K 3/00; C10M 125/10

[52] U.S. Cl. ..... 252/74; 252/78.3; 252/78.5; 252/572; 423/306; 423/330.1; 423/502; 423/DIG. 30; 501/12; 501/128; 502/64; 502/65; 502/73

[58] Field of Search ..... 501/12, 128; 423/330.1, 423/306, DIG. 30, 502; 252/570, 572, 74, 78.3, 78.5; 502/64, 65, 73

[56] References Cited

U.S. PATENT DOCUMENTS

| | | | |
|---|---|---|---|
| 2,995,421 | 12/1961 | Dyer et al. | 423/306 |
| 3,443,892 | 5/1969 | Wacks et al. | 423/306 |
| 4,178,354 | 12/1979 | Murata et al. | 423/306 |
| 4,645,614 | 2/1987 | Goossens et al. | 252/75 |
| 4,668,417 | 5/1987 | Goossens et al. | 252/75 |
| 4,673,559 | 6/1987 | Derouane et al. | 423/306 |
| 4,687,589 | 8/1987 | Block et al. | 252/73 |
| 4,702,855 | 10/1987 | Goossens et al. | 252/75 |
| 4,744,914 | 5/1988 | Filisko et al. | 252/74 |
| 5,122,292 | 6/1992 | Eusebi et al. | 252/75 |
| 5,122,293 | 6/1992 | Eusebi et al. | 252/73 |
| 5,130,039 | 7/1992 | Bloink et al. | 252/74 |
| 5,316,687 | 5/1994 | Bloink et al. | 252/71 |
| 5,326,464 | 7/1994 | von Ballmoos et al. | 208/110 |

OTHER PUBLICATIONS

Block H. and Kelly J. P., "Review Article Electro–rheology" *J. Phys. D. Appl. Phys.*, v. 21, pp. 1661, 1666–1667 1988.

Wang, Hwei–Rung, "Synthesis & Characterization of Alumino–silicates as Inclusions in Electrorheological Materials", pp. 1–11, verbal presentation on Dec. 3, 1990 at private Program Sponsor meeting at the University of Michigan.

*Primary Examiner*—Paul Lieberman
*Assistant Examiner*—Gregory R. Delcotto
*Attorney, Agent, or Firm*—Harness, Dickey & Pierce

[57] ABSTRACT

An electrorheological fluid that includes a dispersed particulate phase of anhydrous amorphous ceramic particles. The anhydrous amorphous ceramic particles can be of a very precisely tailored composition that is unavailable in crystalline form, for obtaining enhanced electrorheological response. The amorphous particles are substantially free of water when used, and have reduced tendency to absorb water in use. Accordingly, the electrorheological fluid containing anhydrous amorphous electrorheologically responsive ceramic particles has wide applicability for use, and enhanced durability in such use.

5 Claims, 16 Drawing Sheets

ANHYDROUS AMORPHOUS CERAMICS AS THE PARTICULATE PHASE IN ELECTRORHEOLOGICAL FLUIDS

FIELD OF THE INVENTION

Present invention relates to fluid compositions which demonstrate significant changes in viscosity under the influence of an electric field. It more particularly relates to improvements in a dispersed phase of an electrorheological fluid.

BACKGROUND OF INVENTION

A fluid that exhibits changes in viscosity under the influence of an electric field is referred to herein as "an electrorheological fluid". An "electrorheological response" is a phenomenon in which the rheology of a fluid is modified by the imposition of an electrical field. Electrorheological fluids have been known for several decades. A wide variety of such fluids are known in the art. They are also sometimes referred to as electroviscous fluids. It is generally known that electrorheological, or electroviscous, fluids exhibit pronounced resistance to shear, due to the changes in viscosity, in response to application of an electrical field.

Electrorheological fluids generally comprise suspensions of finely divided particles, often crystalline particles, that intentionally contain a certain amount of absorbed water. The suspensions are dispersions of such particles in an electrically non-conductive and non-polar liquid. The presence of the water in or on the dispersed particles has been generally acknowledged to be very important in achieving a significant change in viscosity under the influence of the applied electric field. For example, U.S. Pat. No. 3,047,507 Winslow teaches the addition of excess or absorbed water. In explaining mechanistically the role of the absorbed water, it is postulated that the presence of the absorbed water in or on the particulate material is necessary. It is described as necessary to promote ionization, and thus allow charges to move freely on the surface of the particles when an electric field is imposed.

Except for silica gels, and the like, prior ceramic particle dispersions were of finely divided crystalline particles. Silica gels can be considered to be an amorphous ceramic but they are highly hydrated. As indicated above, water in or on the ceramic particles, whether amorphous or crystalline, has been considered by many to be an important factor that influences magnitude of electrorheological effect. In other words, electroviscosity has been considered by many to be dependent upon water content in or on the dispersed finely divided ceramic particles. Various techniques have been proposed for controlling water content in prior art crystalline particulate materials.

One exception to the foregoing is the teachings of U.S. Pat. No. 4,744,914 Filisko et al. Filisko et al. teach that water content in a crystalline material varies with temperature, and that this variability can provide a variable electrorheological response. Filisko et al. propose an electrorheological fluid having a dispersed phase of a particular crystalline zeolite that is substantially free of adsorbed water. The suspending dielectric fluid is dry, as well as the suspended particles. Hence, little or no water can be lost when the suspension is used above room temperature. Accordingly, the Filisko et al. electrorheological fluid is more stable during use at elevated temperatures. This is particularly important in the automobile industry, which generally requires products to be stable over a temperature range of about −40° to +140° C.

Zeolites are a particular crystalline form of aluminosilicates. However, heretofore, the electrorheological advantages of using anhydrous amorphous ceramic particles as the dispersed phase in an electrorheological fluid have not been recognized. It appears that there may even be special advantages to be obtained with anhydrous amorphous particles produced from a gel or solgel that is rapidly dried. Amorphous materials are not limited to only those compositions which will precipitate or solidify into a crystalline form. Amorphous materials can thus have virtually any composition. This opens the door to the investigation of a wide variety of synthetic ceramic compositions for enhanced electrorheological effects. Even though this recognition is new, enhanced electrorheological effects have already been found. However, it is believed that the work done in this connection is only beginning. This invention makes available the opportunity to very precisely "tailor" the composition of the dispersed particles. Results obtained to date indicate that even more electrorheologically effective anhydrous amorphous materials, and/or anhydrous amorphous material/dielectric fluid combinations, may be found in the future.

As indicated, we have found that dispersed particles of many amorphous ceramic compositions exhibit significant electrorheological response even when substantially free of water. Thus, like the crystalline zeolites disclosed in U.S. Pat. No. 4,744,914 Filisko et al., anhydrous amorphous ceramics can be used in electrorheological fluids at elevated temperatures. This makes them useful in a significant wide variety of applications.

Still further, it is to be recognized that dry materials have a natural tendency to eventually absorb, or re-absorb, water to some extent. However, we have found that anhydrous amorphous ceramic compositions have a decidedly lesser tendency to adsorb, or re-absorb, water than their crystalline counterparts. This can be a very important attribute. Absorption of water by the dispersed particles in an electrorheological fluid can cause the fluid to change its electrorheological response. In other words, the response of the fluid is not stable over time. This is a durability problem. In some applications, as for example automotive applications, long durability is of significant concern. In that sense, this invention can be considered to be a specific improvement on the concepts taught in U.S. Pat. No. 4,744,914 Filisko et al.

A wide variety of substantially dry amorphous ceramic compositions will apparently exhibit a significant electrorheological response. This makes them inherently more useful in a wider variety of applications, including automotive applications and other elevated temperature applications.

Still another attribute of this invention may be realized in a particular method of recovering amorphous particles from a gel or solgel in which they are formed. Tests made thus far indicate that selected compositions of pyrolytically dried gel or solgels provide amorphous ceramic particles of significantly enhanced electrorheological response.

OBJECTS AND SUMMARY OF THE INVENTION

It is an object of this invention to provide an improved electrorheological fluid.

It is another object of this invention to provide an electrorheological fluid having a substantially dry amorphous ceramic particulate phase.

It is still another object of this invention to provide a method of making amorphous particles for an electrorheological fluid.

It is a further object to provide improved compositions for use as either amorphous or crystalline particles in an electrorheological fluid.

These and other objects, features, and advantages of this invention are obtained with an electrorheological fluid containing a substantially water-free amorphous ceramic particulate phase dispersed in a substantially non-polar and electrically nonconducting fluid. Preferably, the amorphous ceramic has the following chemical composition:

$$A_{(a/n)}D_{(d/m)}[(FO_i)_x(GO_j)_yRO_k)_z]wH_2O$$

where A, D, F, G and R are as hereinafter defined; a is any real number excluding zero; and d, i, j, k, x, y, and z each is any real number including 0, provided that i, j, and k, cannot concurrently all be 0, and further provided that if i, j, or k is not 0, then x, y, or z, respectfully, is also not 0. In a preferred embodiment fine particles of the above composition, are produced by pyrolytic drying of a gel or solgel.

Other objects, features and advantages of this invention will become more apparent from the following description of preferred examples thereof and from the drawing.

BRIEF DESCRIPTION OF THE DRAWING

FIGS. 1–10 represent plots of shear stress at various applied electric fields and various shear rates and temperatures.

FIGS. 2–10 represent plots of an electrorheological fluid containing an amorphous dispersed phase of various compositions.

DESCRIPTION OF THE PREFERRED EMBODIMENTS

Figure 1B:
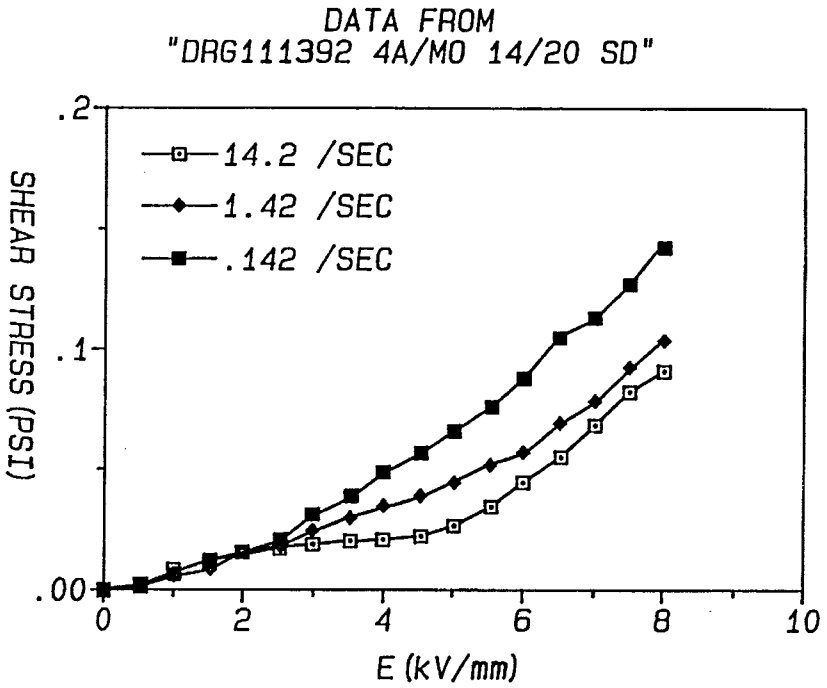
FIGS. 1A–1D represent plots for an electrorheological fluid containing a crystalline dispersed phase of various compositions.

As indicated above, this invention involves dispersing particles of a substantially water-free amorphous ceramic composition in a dielectric fluid to form a electrorheological fluid. Such particles may be referred to herein as the dispersed phase. Amorphous connotes that a material has no regular structure; that it is non-crystalline. On the other hand, it should be recognized that microcrystals can exist, or give some evidence that they exist, in materials accepted as amorphous materials. We recognize that this may be true in our amorphous materials as well. However, the microcrystals are so small as to not be readily discernable. Accordingly, by the term "amorphous" as used in this invention, we mean that no significant order can be discerned by x-ray spectroscopy. Accordingly, if any order is present, it is only on an extremely small scale. One can refer to such materials as "x-ray amorphous". Accordingly, by the term "amorphous", we mean to include materials that might be semi-ordered but not on a scale that is readily discernable by x-ray spectroscopy.

Reference is now made to the size of the amorphous ceramic particles used in the electrorheological fluid of this invention. It appears that the same particle sizes that would be traditionally used for crystalline particles can also be used for the amorphous particles of our invention. It does not appear that there is any significant differences one needs to observe in terms of particle size, when one uses an anhydrous amorphous ceramic particle, as opposed to a crystalline or hydrated amorphous ceramic particle. By way of example, one could use particles having an average particle size from about 0.1 micron to about 100 microns. Traditionally, they will have a particle size distribution in which the maximum particle size will be less than about 50 microns. In general, particle size should not be so small, i.e, less than about 0.1 micron, that attractive forces between particles tend to mask electrorheological results. On the other hand, they should not be so large as not stay dispersed in the dielectric fluid.

As for composition, we believe that any substantially water-free amorphous ceramic of the following formula can be used:

$$A_{(a/n)}D_{(d/m)}[(FO_i)_x(GO_j)_yRO_k)_z]wH_2O$$

Where A, D, F, G, R, H and O, as well as i, j, k, x, y and z are as hereinafter described. The letter n refers to the average valence charge of A. The letter a is a multiplier of A that relates to n, and cannot be zero. The letter m refers to the average valance charge of D. The letter d is a multiplier for D, and relates to m. The multiplier a can be a different number from that of the multiplier d.

A can be a single metal cation of valence charge n but not sodium if (1) D and R is absent, (2) if F is present and is aluminum, and (3) if G is present and is silicon. In the alternative, A can be a mixture of metal cations of various valences, which mixture has an average valence charge n. In many examples of this invention, A is an alkaline metal such as lithium, sodium, potassium or cesium. A could also be a metal such as silver or could be a mixture of metals, as for example sodium and potassium.

D is an anion of valence charge m, as for example chloride. On the other hand, it could be a mixture anions of average valence charge m, as for example chloride and fluoride, nitride or sulfide.

F is a trivalent element, most commonly boron or aluminum, or is a mixture of trivalent elements.

G is a tetravalent element most commonly silicon, or is a mixture of tetravalent elements.

R is a pentavalent element, most commonly phosphorous but also possibly antimony, arsenic or bismuth. However, it can also be a mixture of such pentavalent elements.

O ordinarily would be oxygen. However, it could also be sulphur or nitrogen. It could also be a mixture of such elements, or the sulfur and nitrogen could be present in only surface portions of the particles. The sulphur or nitrogen could be present as the composition as originally formed, or introduced into the composition by substitution for oxygen in a sulphidation or nitridation process.

The quantities i, j, k, x, y and z each is any real number including 0. However, i, j and k cannot concurrently all be 0. Moreover, if i is not 0, then x is not 0. Similarly, if j is not 0, y is not 0. Also similarly, if k is not 0 then z is not 0.

One of the more important advantages of the foregoing is the virtual infinite variability in composition that is possible when one uses an amorphous composition as opposed to a crystalline composition. The reason for this is that in a crystalline composition, one is limited to the particular molecular ratios that will precipitate in a crystalline form. Accordingly, if one precipitates or solidifies a composition in crystalline form, one will only obtain those compositions which happen to have a crystalline form. In amorphous materials, on the other hand, one is not limited merely to the molecular compositions that can precipitate or solidify in crystalline form. Accordingly one can "tailor" a ceramic composition in a new way. Its composition can be extremely precisely "tailored" to obtain the maximum enhanced rheological and/or durability effect. Hence, amorphous materials give one a mechanism by which non-naturally occurring, i.e., synthetic, ceramic compositions can be explored. It is believed that the amorphous compositions tried so far as amorphous materials in this invention are not necessarily the best compositions that one will find. However, what has been tried thus far, and the examples of it described herein, give rise to the expectation that still better amorphous electrorheological particles, or particle/dielectric fluid combinations, will be found. They may exhibit still more improved electrorheological response and/or durability.

In the above formula $H_2O$ indicates water, and refers to water of hydration. The lowercase letter w is a multiplier of the molecules of water of hydration. As previously indicated, w preferentially is a small number. It is not yet clear if w can be zero or not. It may be that some minimal amount of water of hydration or some other form is actually needed for the composition to exhibit any significant electrorheological response. In any event, w is any low number resulting from two heat treatments of the amorphous material at a temperature of about 400–600° C. for at least about five hours in each heat treatment. Accordingly, in this invention, by an amorphous ceramic that is "anhydrous" or "substantially water-free" or "substantially dry", we mean an amorphous ceramic having a water content not substantially greater than that which would result from two heat treatments at a temperature of at least about 400° C. for at least about 5 hours each.

It was mentioned above that many ceramic particles may eventually absorb, or re-absorb, water to some extent after they have been heated to dry them. One may think that the rate at which water is absorbed or re-absorbed by crystalline ceramic materials is quite slow. However, for applications where stability over periods of years is desired, even slow re-absorption of water would be undesirable. It could adversely affect long term durability of an electrorheological fluid. In automotive applications, durability of at least five years might be required, and perhaps even ten years. In this invention, we have found that amorphous ceramic compositions re-absorb water at a noticeably lesser rate than crystalline ceramic compositions. Accordingly, electrorheological fluids made with amorphous ceramic compositions can provide a noticeable improvement in durability, if not electrorheological response.

The non-polar electrically nonconductive fluid used to disperse the amorphous ceramic particles in our electrorheological fluid, can be the same as is used in any other electrorheological fluid. In other words, the non-polar nonconductive fluid can be a paraffin oil, silicone oil, hydrocarbon oil, chlorinated hydrocarbon oil, etc. The hydrocarbon oil need not be just a paraffin oil but could be an aromatic oil as for example decahydronaphthalene. We note that particles of some amorphous ceramic compositions provide a greater enhancement in electrorheological response in some dielectric fluids than others.

A convenient technique for making small particles of amorphous ceramic is to form a liquid mixture of metal alkoxides, and then dry the mixture and pyrolyze it. However, the electrorheological fluids reported on herein were made with amorphous powders made by first forming a gel or solgel of the metal alkoxide mixture, and then rapidly drying it. More specifically, in the gel or solgel technique, metal alkoxides are mixed together in appropriate proportions that represent an intended amorphous composition. This mixture is liquid and is heated to a suitable temperature that is below the boiling point of water. It is then rapidly mixed with water that is also at an elevated temperature. Water displaces the alcohol from the metals and other elements of the alkoxides, to form a gel or solgel. The gel or solgel thus contains organics and water, as well as elements that will comprise the amorphous ceramic composition. Enough water is added to provide a gel or solgel containing about 0.5–15% solids.

We believe that enhanced electrorheological response in amorphous particles can be obtained if the gel or solgel is rapidly heated to drive off the water. We refer to the rapid heating as "pyrolytic drying". By "pyrolytic drying", we mean heating the precursor of the amorphous ceramic composition fast enough to preserve homogeneity in the resultant amorphous ceramic. In other words, fast enough to prevent separate phases of oxides from separating out in the amorphous material. When one uses the gel or solgel technique, "pyrolytic drying" is performed by placing the gel or solgel in an oven preheated to 400° F., and leaving the gel or solgel in the oven while it is maintained at that temperature for at least 5–6 hours. During this "pyrolytic drying", the organics in the gel or solgel, principally alcohols, are rapidly driven off and may even combust. However, not all of the carbon in these organic compounds is necessarily removed during this "pyrolytic drying". As a result, the gel or solgel collapses into a black mass of agglomerated particles.

The agglomerated black mass is then put into an oven at 400–600° C., and held at that temperature for at least about 5–6 hours, perhaps even 12 hours. If desired and practical, this second heating can be done in the same furnace as the pyrolytic drying and immediately at the conclusion of the pyrolytic drying. However, the agglomerated mass could be cooled to room temperature and then heated the second time by placing the room temperature agglomerated mass into an oven preheated to 400–600°. During this second heat treatment for 5–6 hours, the mass whitens measurably. Following this second heating, the mass is ground, resulting in a powder having an average particle size of about 5 microns. The powder is then heated again to about 400–600° C. for at least about five hours, and perhaps 8 to 12 hours. Neither heat treatment requires any particular heating schedule. Room temperature powder can be placed directly into the preheated oven for treatment. When heat treatment is concluded, the powder can be removed from the hot oven directly into room temperature air, and allowed to cool naturally there.

After the second heat treatment at 400–600° C., the amorphous ceramic particles may be ready for use. On the other hand if they do not appear to be completely white one may choose to reheat them to 400–600° C. for the same amount of time as used for the initial second heat treatment but in this latter instance, blow pure oxygen onto the powder during the heat treatment. One may prefer to blow pure oxygen onto the powder as a standard practice in the second heat treatment, and avoid need for a third heat treatment.

Results obtained thus far indicate that the "pyrolytic drying" hereinbefore described may provide a special effect on the gel or solgel, and/or the resulting powder, during the first heat treatment. It may be the principal basis upon which enhanced electrorheological response is obtained with at least some of the anhydrous amorphous particles. It is possible that a special collapse of the gel or solgel is produced by our special "pyrolytic drying" technique, and that it in some way produces amorphous particles having enhanced electrorheological response. More testing is being done to confirm this. If true, then this invention not only provides a means for obtaining compositions that were heretofore not available, but also provides a means for enhancing electrorheological effect of anhydrous amorphous ceramic particles of given compositions. In another sense, "pyrolytic drying" is a modification to a known technique for making amorphous ceramic powder that provides a distinctive amorphous ceramic powder.

Reference is now made to the Drawing in which each FIGS. 1 through 10 are plots of shear stress versus applied electric field at various shear rates and testing temperatures for a variety of ceramic materials. Shear stress is plotted in pounds per square inch as the ordinate, and applied electric field is plotted as kilovolts per millimeter as the abscissa. All of the tests represented in the plots of the Drawing were conducted under similar conditions except for the differences stated. The testing technique used is referred to in the publication Filisko, F. E. and Radziowski, L., "Intrinsic Mechanism For Activity of Aluminosilicate—Based Rheological Fluids", *Journal of Rheology*, v. 34, n 4 pp. 539–552.

Figure 1A:
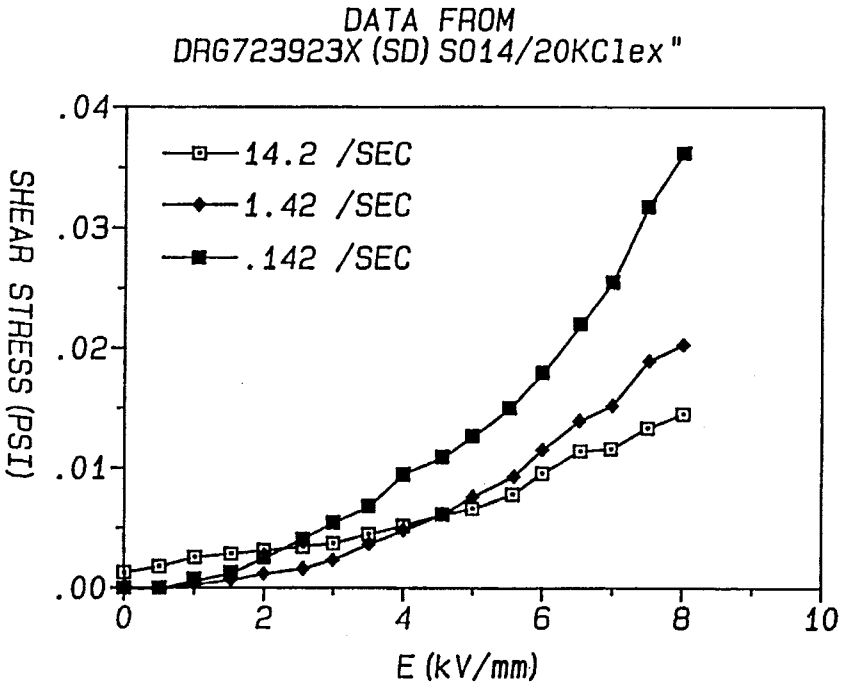
Figure 1D:
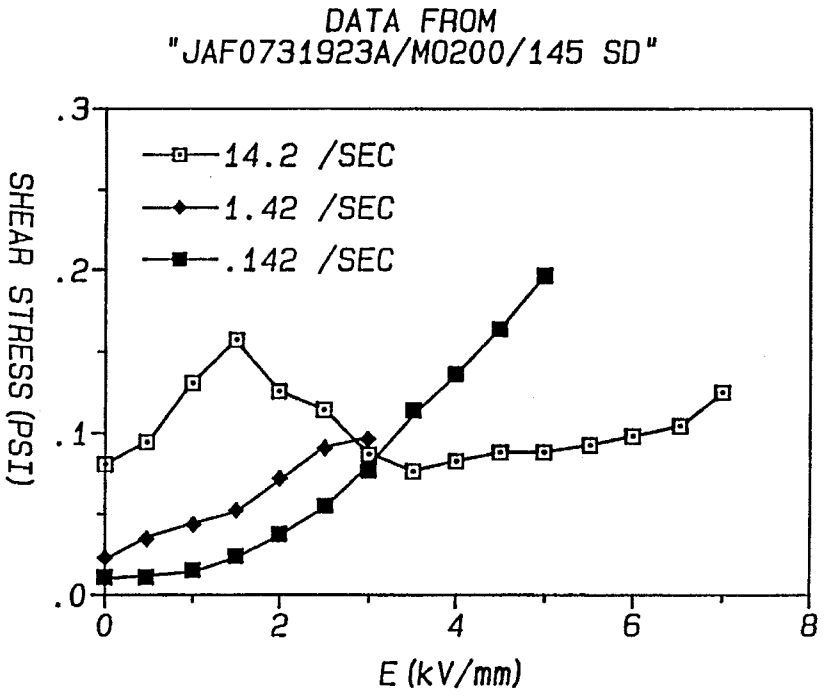
Figure 1C:
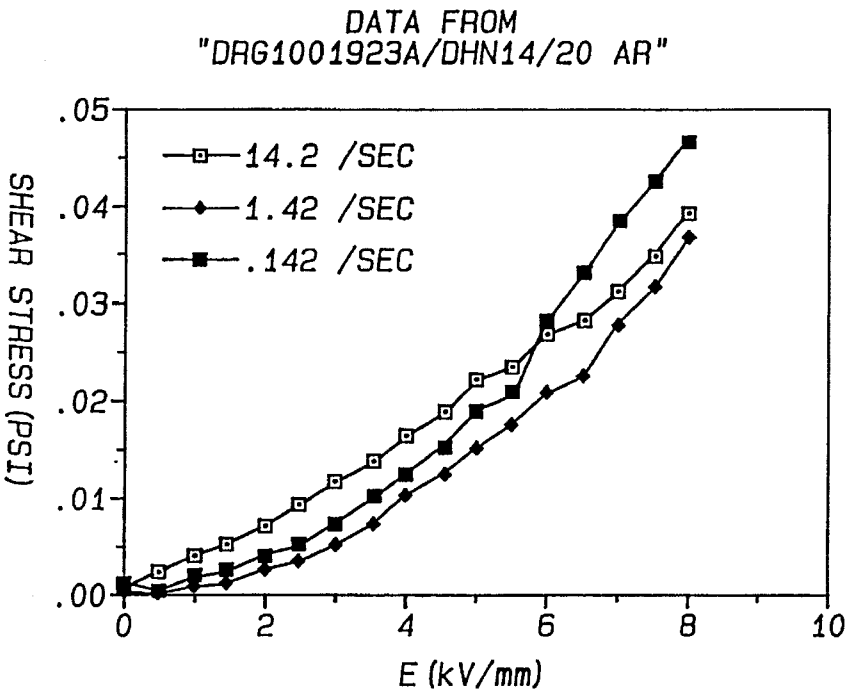

It should also be mentioned that, as hereinbefore indicated, many electrorheological fluids in the past have shown decreased electrorheological response at elevated temperatures, perhaps through loss of water. It can be seen that many of our electrorheological fluids were tested at elevated temperatures, and provided significant effects at elevated temperatures, even enhanced effects. Reference is now specifically made to FIGS. 1*a*–1*d*. The electrorheological fluids represented in FIGS. 1*a*–1*d* each have a crystalline ceramic dispersed phase. For comparison, all of FIGS. 2–10 represent tests of fluids containing an anhydrous amorphous ceramic dispersed phase. All of the tests represented in FIGS. 1A–1D were conducted at room temperature. FIG. 1A represents rheological testing of a fluid made of 14 grams of crystalline sodium/potassium aluminosilicate $[K_9Na_3(AlO_2)_{12}(SiO_2)_{12}]$, which is a UOP-3A zeolite, that is dispersed in 20 ml of silicone oil. The sample powder was washed in potassium chloride for two days before testing. The sample represented in FIG. 1B was 14 grams of crystalline sodium aluminosilicate $[Na_{12}(AlO_2)_{12}(SiO_2)_{12}]$, which is a UOP-4A zeolite, that was dispersed in 20 ml paraffin oil. The sample was tested as received. FIG. 1C represents testing of a fluid made from dispersing 14 grams of crystalline sodium/potassium aluminosilicate $[K_9Na_3(AlO_2)_{12}(SiO_2)_{12}]$, which is a UOP-3A zeolite, dispersed in 20 ml of decahydronaphthalene. The sample was tested as received. The sample shown in FIG. 1D had a higher particulate concentration. This sample had 200 grams of crystalline potassium aluminosilicate $[K_9Na_3(AlO_2)_{12}(SiO_2)_{12}]$, which is a UOP-3A zeolite, dispersed in 145 ml of paraffin oil. The sample was tested as received. Reference is now made to FIGS. 2 through 10 for comparison purposes. However, it should be noted that FIGS. 1*a*–1*d* are not purported to be the best electrorheological crystalline materials available. They are reported here because they were available, and not considered to be unduly poor samples of electrorheological fluids having dispersed crystalline ceramic particles. Further, it should be noted that all of the amorphous particles used in the fluids of FIGS. 2–10 were prepared by the aforementioned "pyrolytic drying" technique, and oxygen was blown on the powder during the second heat treatment. Also, when we refer to the testing temperature as being at given temperature, we mean that the fluid being tested is at that temperature.

Figure 2B:
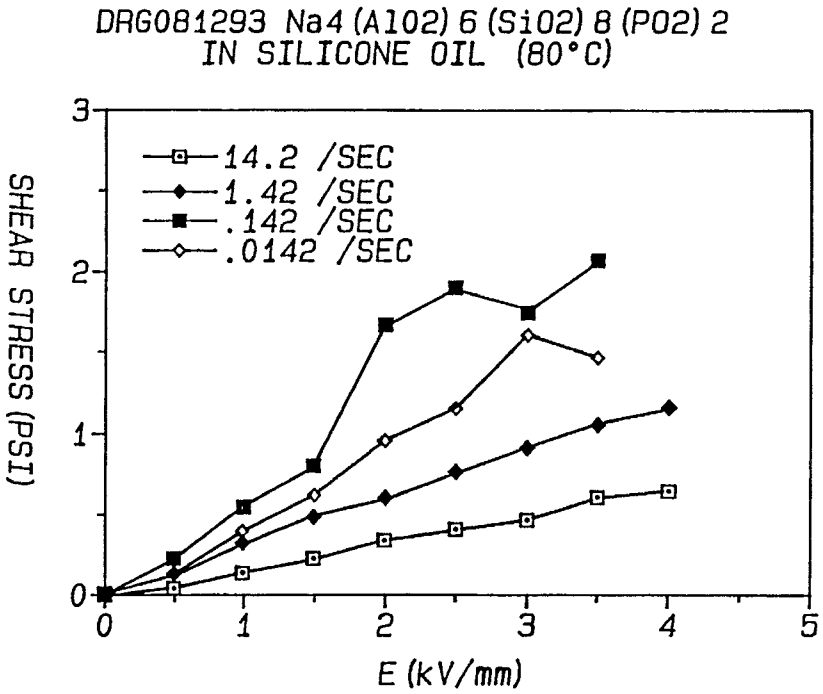
Figure 2A:
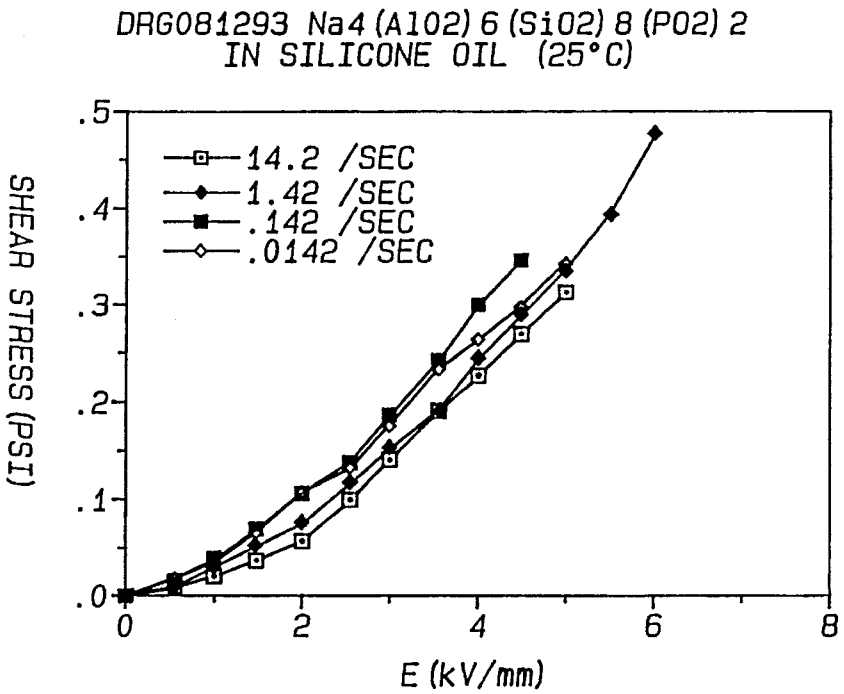
Figure 2D:
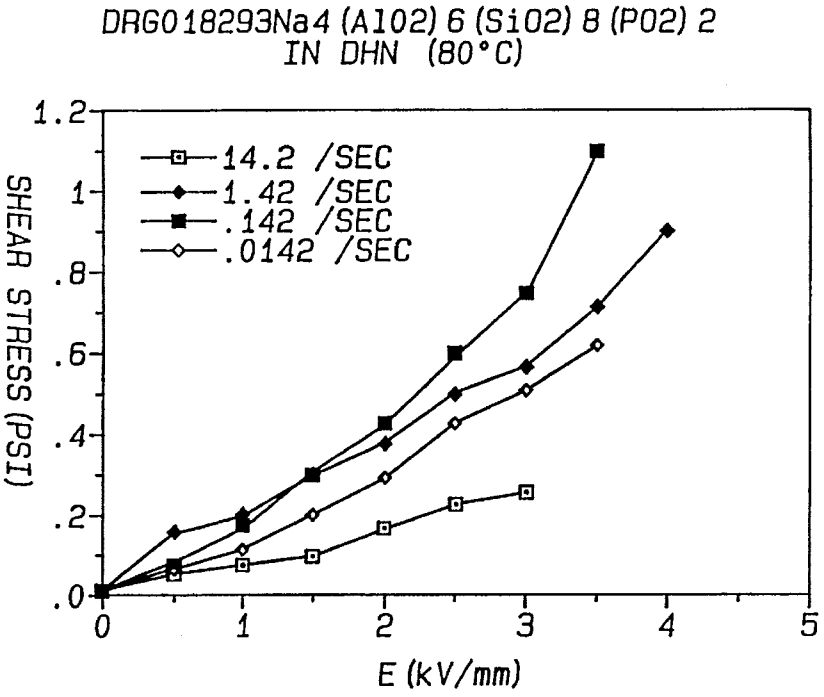
Figure 2C:
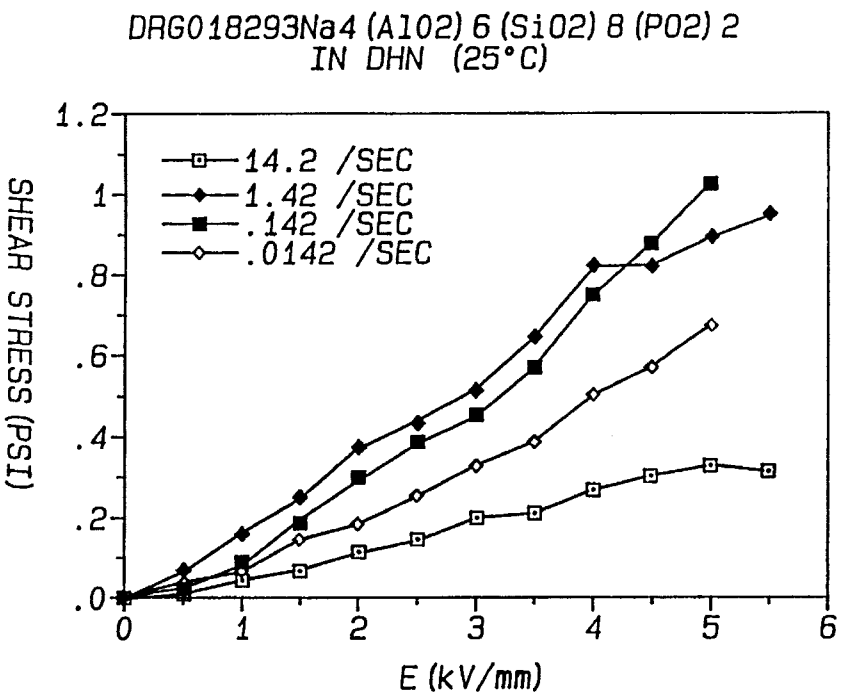

Specific reference is now made to FIGS. 2A–2D. They each show results of testing a sample fluid made of 14 grams of amorphous, substantially water-free, sodium aluminosilicophosphate $[Na_4(AlO_2)_6(SiO_2)_8(PO_2)_2]$ $wH_2O$ immersed in 30 ml of a non-polar dielectric fluid. In FIG. 2A the fluid is silicone oil, and the rheological study was conducted at 25° C. FIG. 2B shows test results for the same composition as tested in FIG. 2A but the rheological tests were conducted at 80° C. In FIG. 2C, the dielectric fluid in the sample tested was decahydronaphthalene, with the test temperature being 25° C. The sample tested in FIG. 2D was the same composition as the sample represented in FIG. 2C but the testing temperature was 80°.

Figure 3B:
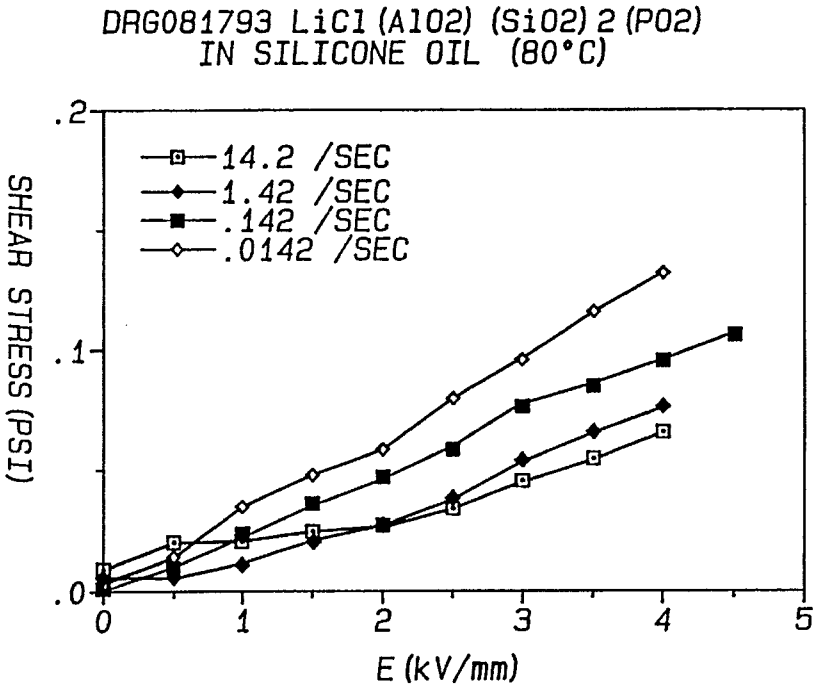
Figure 3A:
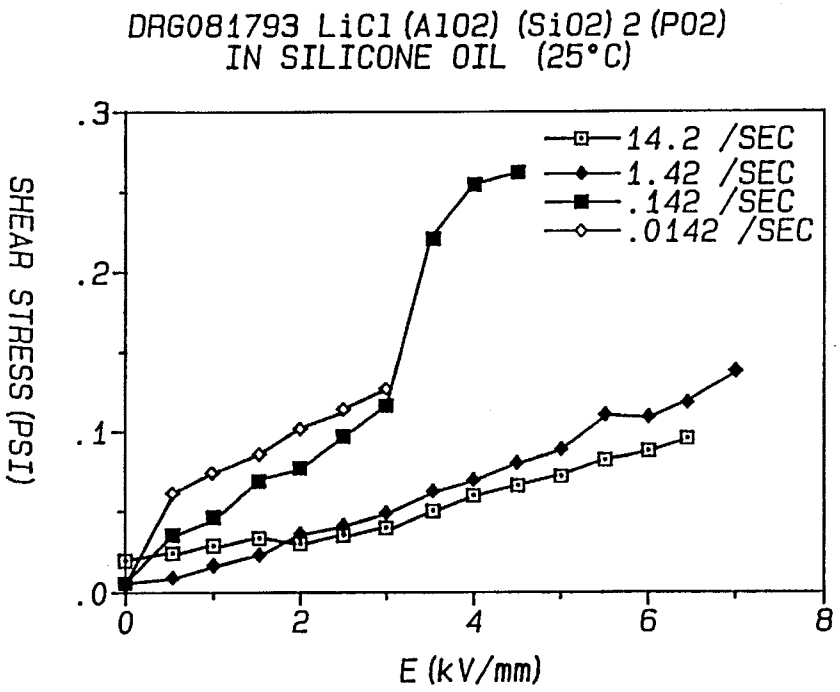
Figure 3D:
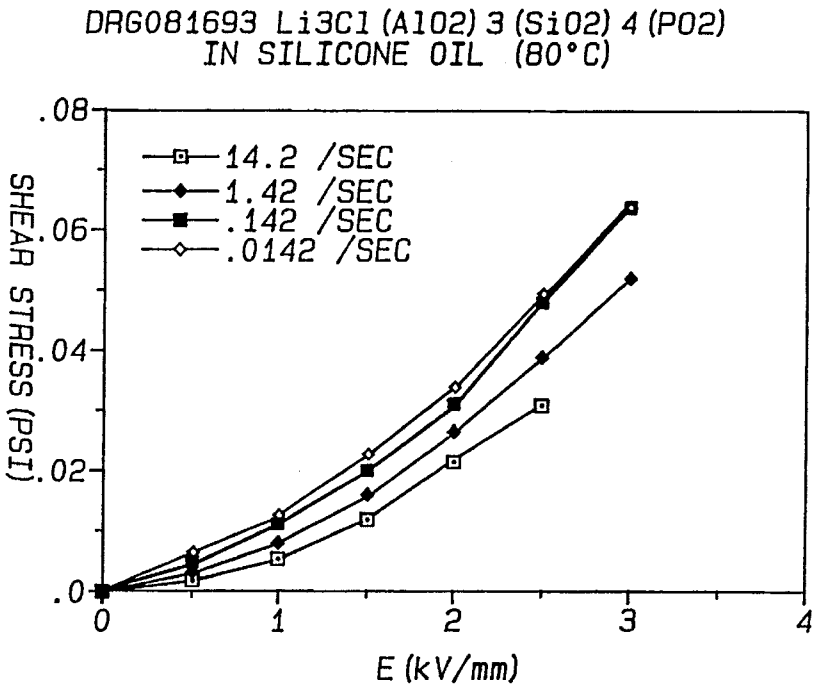
Figure 3C:
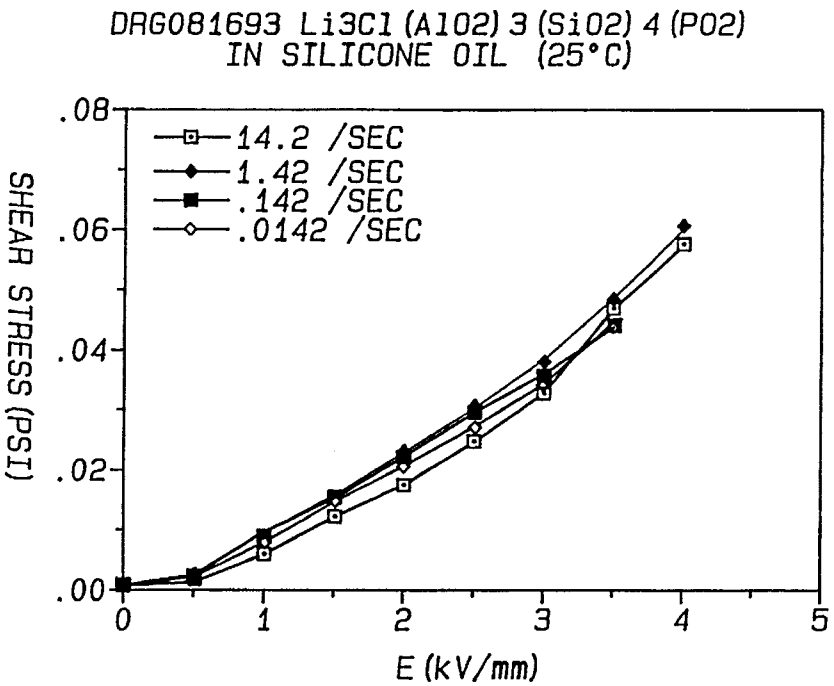
Figure 4B:
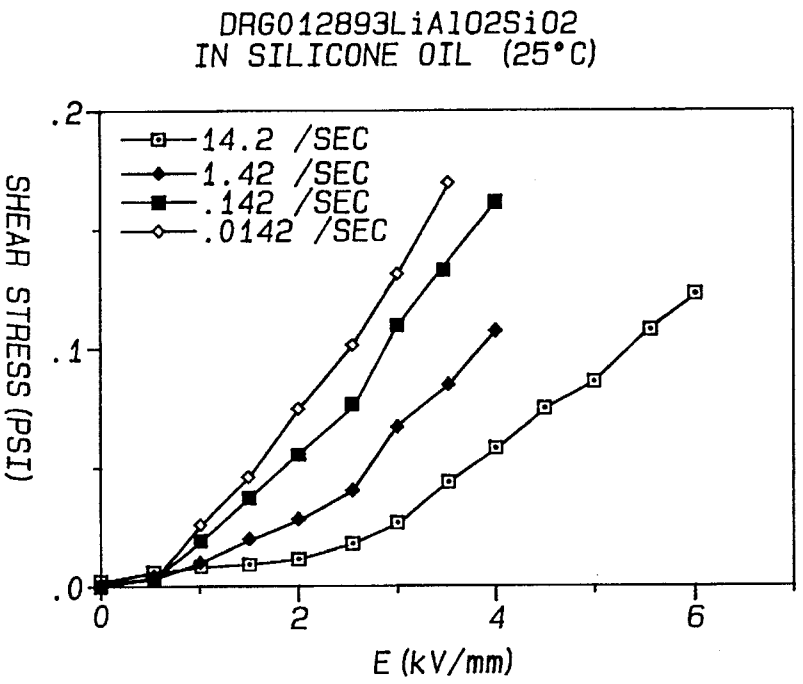
Figure 4A:
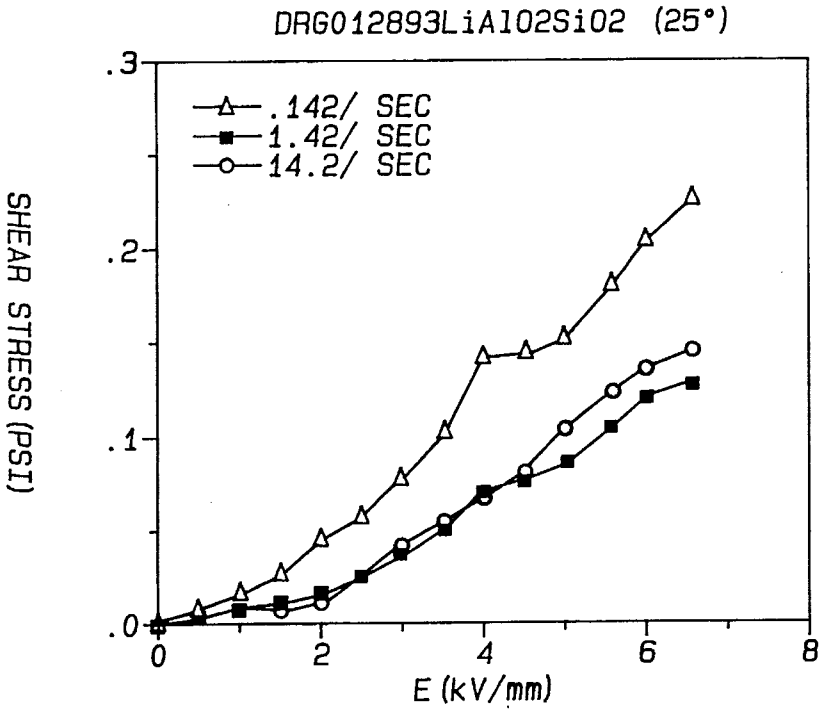
Figure 4D:
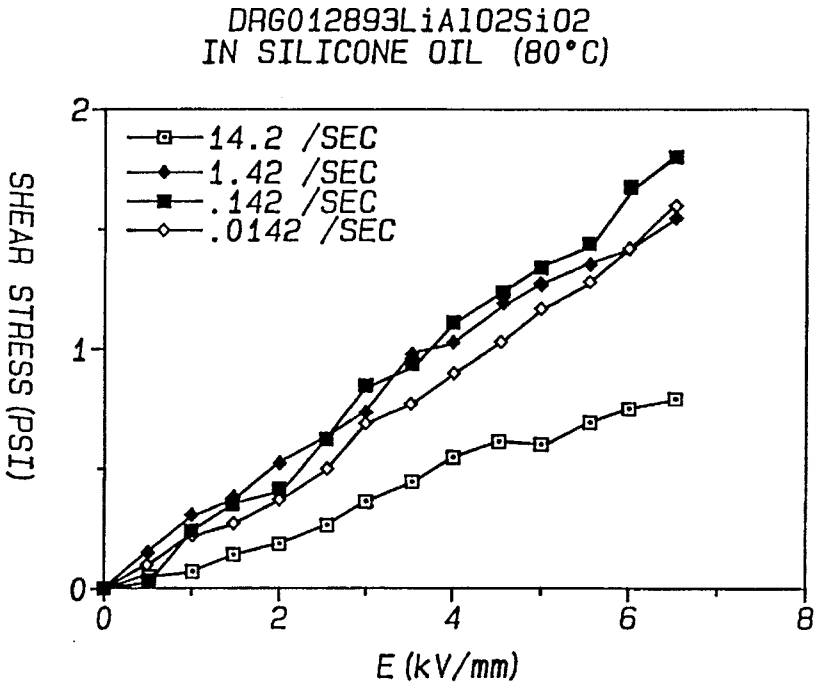
Figure 4C:
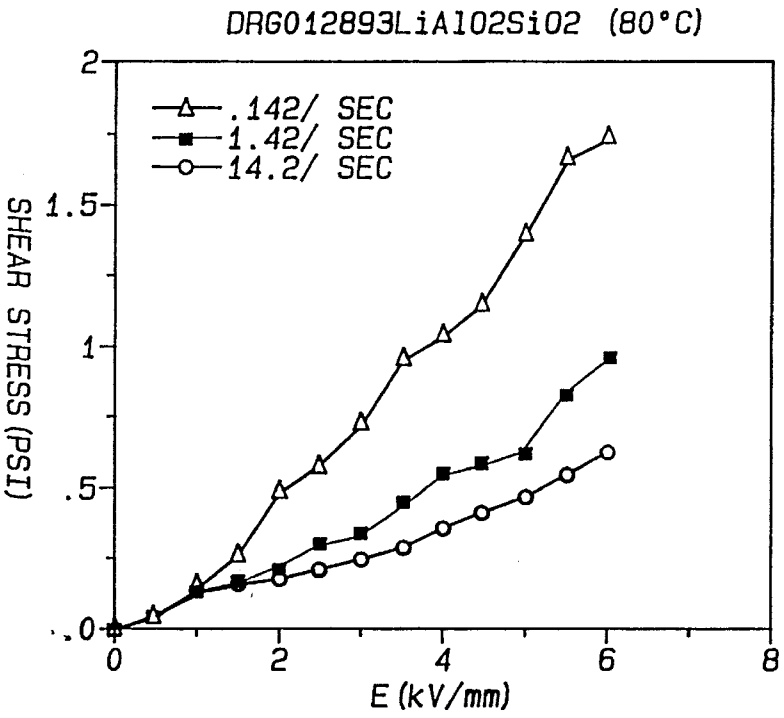

The electrorheological fluid represented in FIGS. 3A–3D was 14 grams of amorphous, substantially water-free, (lithium, chloride )-aluminosilicophosphate powder dispersed in 30 ml of silicone oil. In FIGS. 3A and 3B the chemical formula of the powder was $[LiCl(AlO_2)(SiO_2)_2(PO_2)]$ $wH_2O$, with the test temperature being 25° C. for the tests of FIG. 3A and 80° C. for the tests of FIG. 3B. In FIGS. 3C and 3D, the composition was $[LiCl(AlO_2)_3(SiO_2)_4(PO_2)]$ $wH_2O$ with the testing temperature being 25° C. for the tests represented in FIG. 3C and 80° C. for the tests represented in FIG. 3D. Aluminosilicophosphates may be new per se as dispersants in an electrorheological fluid, and at least (lithium, chloride)-aluminosilicophosphate, whether such compositions are in crystalline or amorphous form.

FIGS. 4A–4D represent the results of testing an electrorheological fluids made of 14 grams of amorphous, substantially water-free, lithium aluminosilicate $[Li(AlO_2)(SiO_2)]$ $wH_2O$ powder dispersed in a non-polar dielectric fluid. For FIG. 4A, the dielectric fluid is 20 ml of paraffin oil, and the testing temperature is 25°. For FIG. 4B, the dielectric fluid is 30ml of silicone oil, and the testing temperature is 25° C. For FIG. 4C, the dielectric fluid is 20 ml of paraffin oil, with the testing temperature being 80° C. For FIG. 4D, the dielectric fluid is 30 ml of silicon oil, and 80° C. is the testing temperature.

Figure 5B:
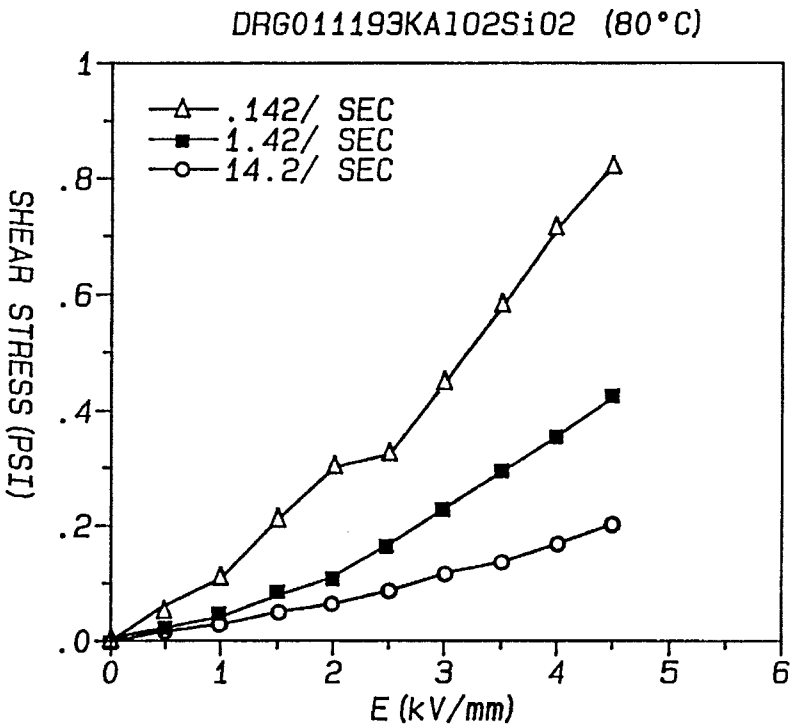
Figure 5A:
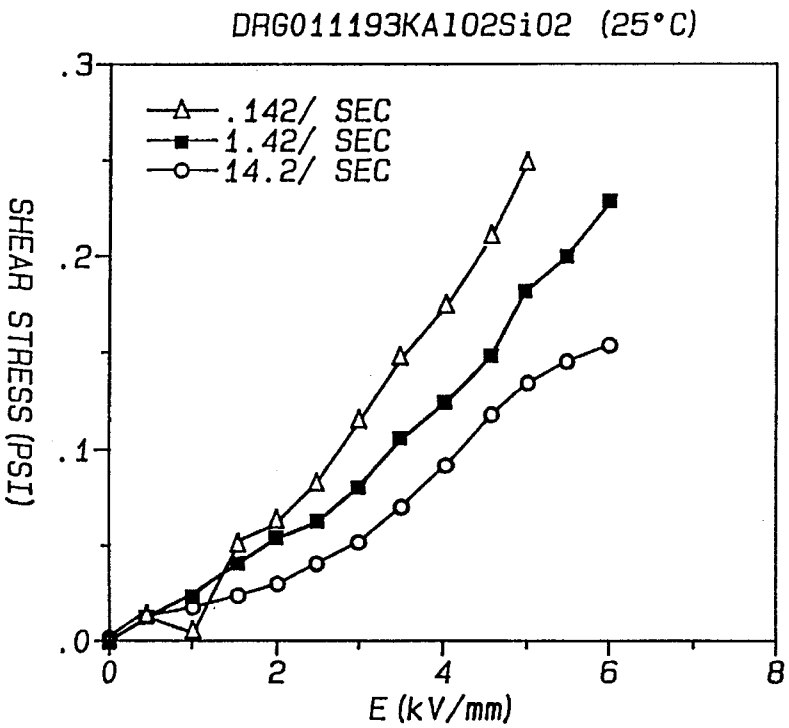
Figure 5D:
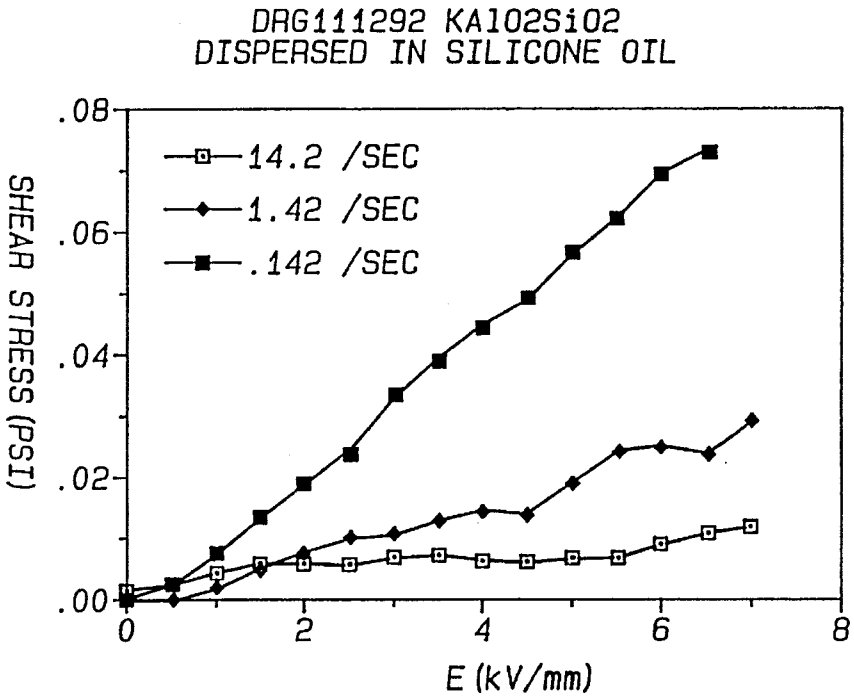
Figure 5C:
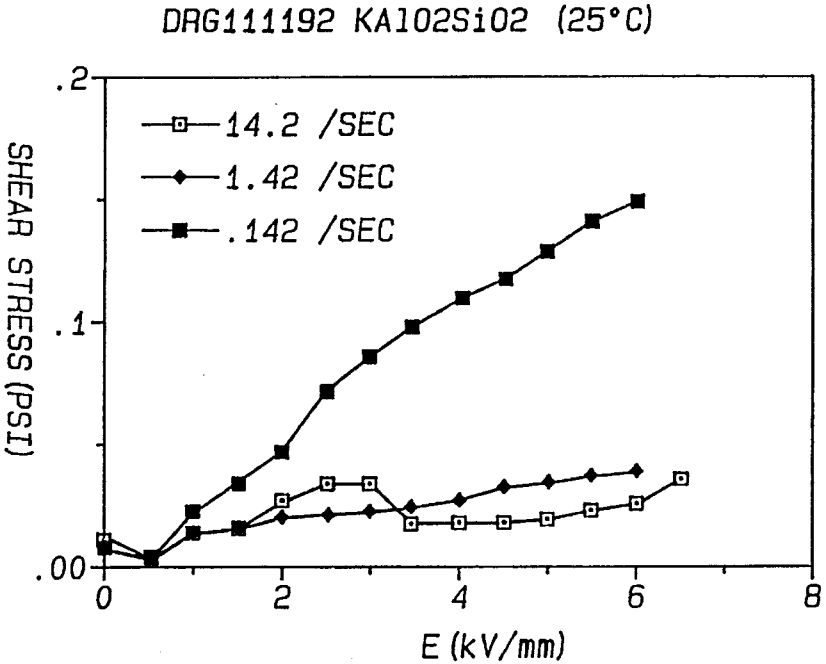

The electrorheological fluids represented in FIGS. 5A–5D are made of 14 grams of amorphous, substantially water-free, potassium aluminosilicate $[K(AlO_2)(SiO_2)]$ $wH_2O$, powder. In FIG. 5A the amorphous ceramic powder was dispersed in 20 ml of paraffin oil, with the rheological study being conducted at 25° C. In FIG. 5B the amorphous, substantially water-free, ceramic powder was dispersed in 20 ml of paraffin oil, with the rheological study being conducted at 80° C. In FIG. 5C the amorphous, substantially water-free, ceramic powder was dispersed in 30 ml of paraffin oil, with the rheological study being conducted at 25° C. In FIG. 5D the amorphous, substantially water-free, ceramic powder was dispersed in 30 ml of silicone oil, with the rheological study being conducted at 25° C.

Figure 6B:
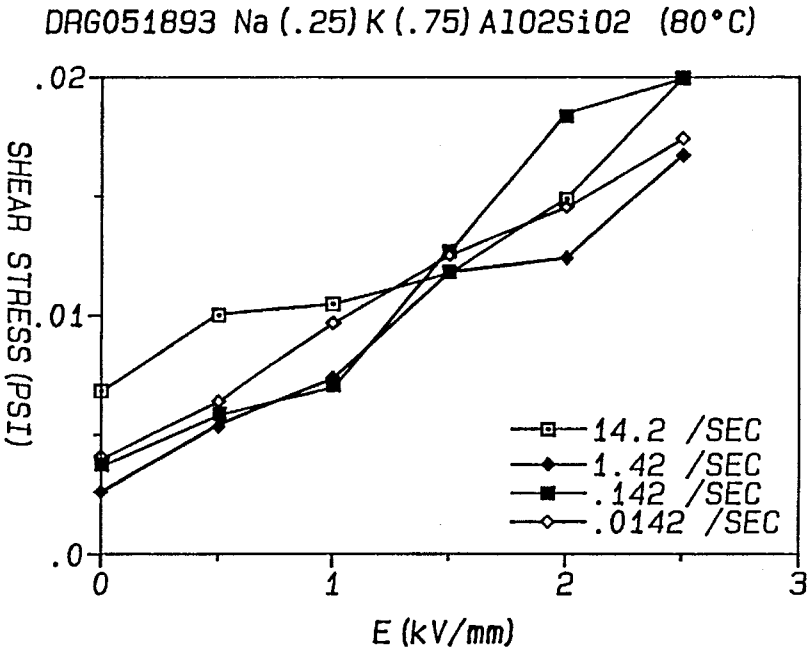
Figure 6A:
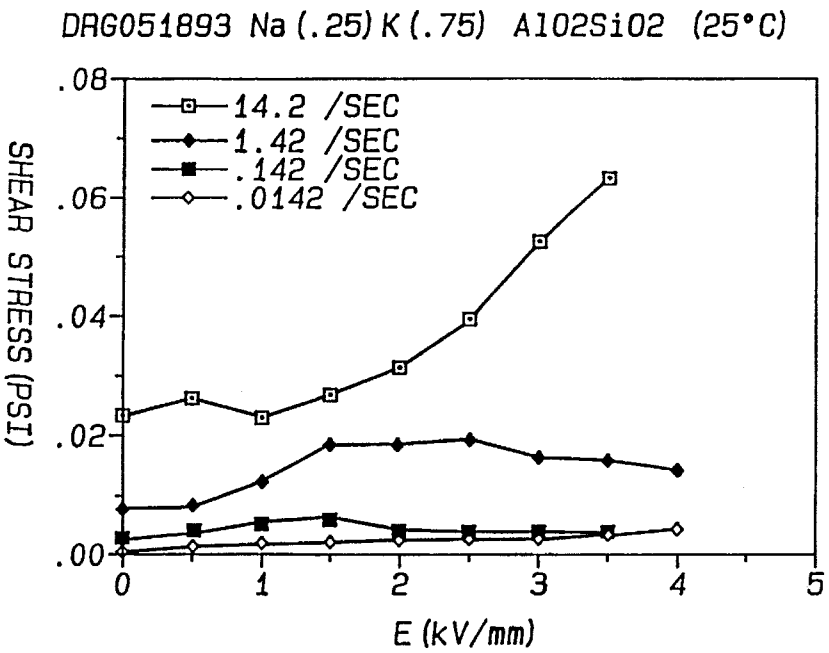
Figure 6D:
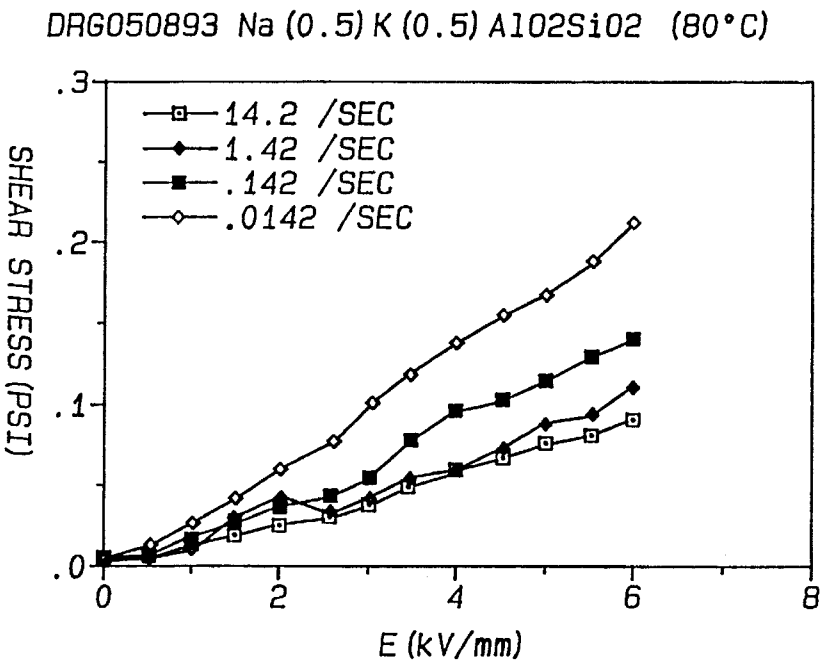
Figure 6C:
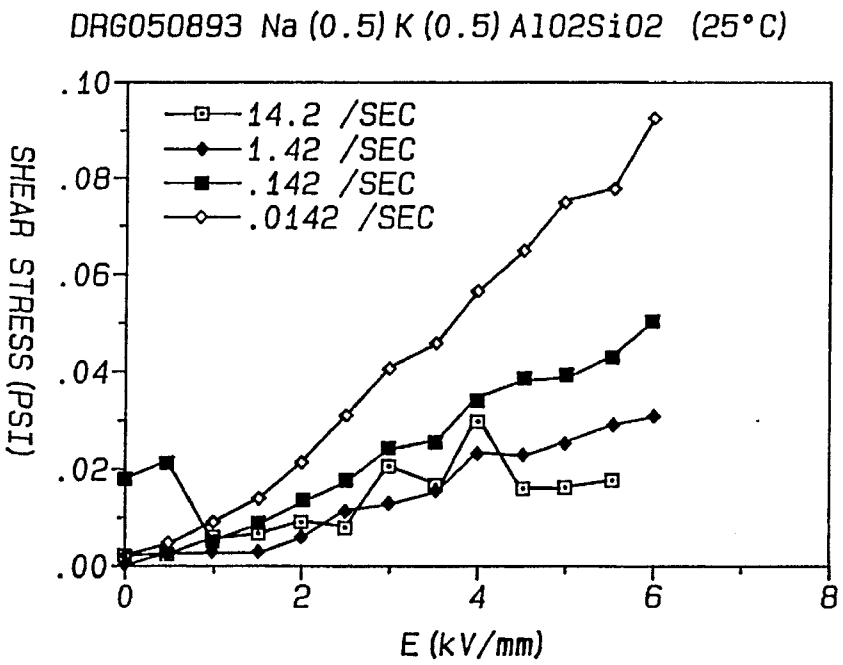
Figure 6F:
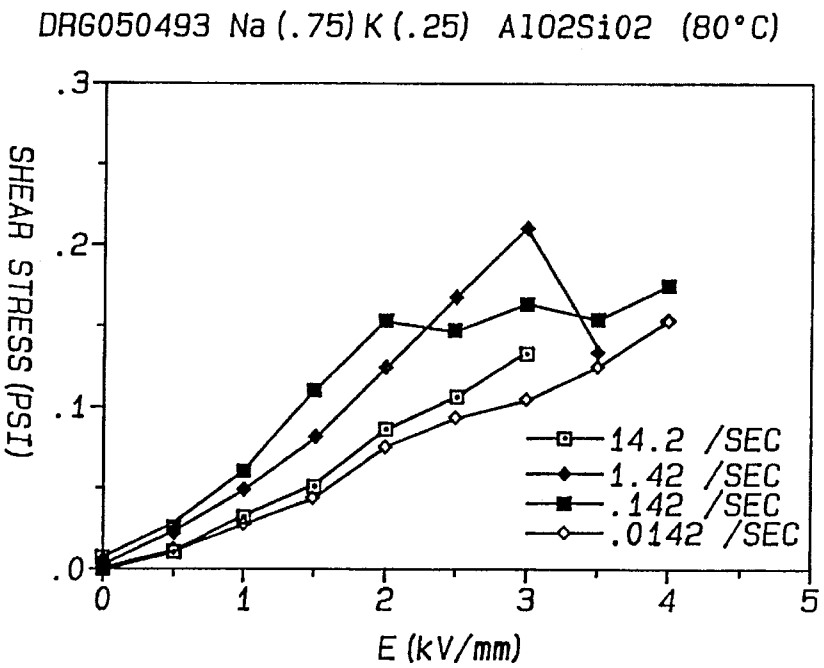
Figure 6E:
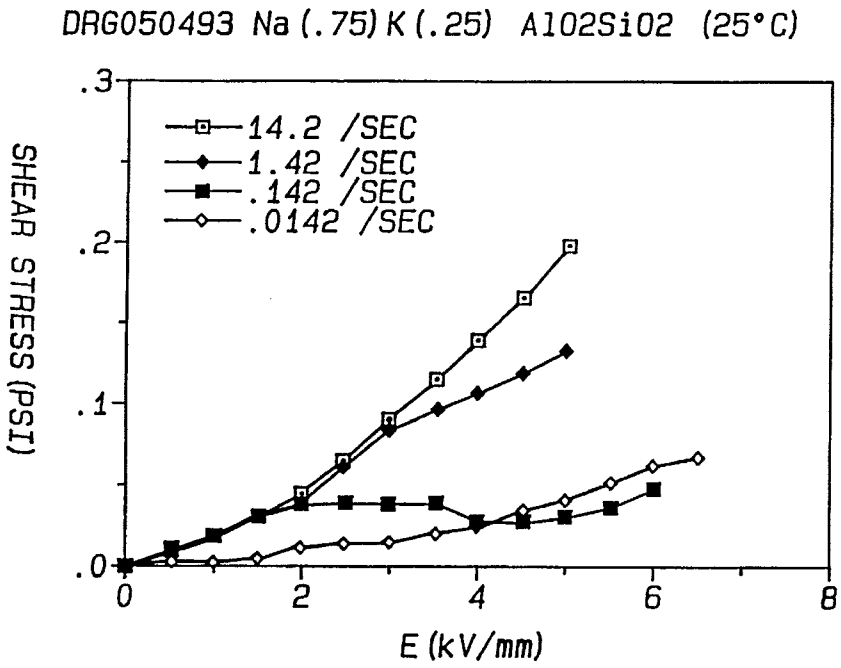

The electrorheological fluid of FIGS. 6A–6F was made of 14 grams of amorphous, substantially water-free, potassium aluminosilicate powder of various compositions dispersed in 30 ml of paraffin oil. In FIGS. 6A and 6B the composition was $[Na_{0.25}K_{0.75}(AlO_2)(SiO_2)]$ $wH_2O$, with the rheological test being conducted at 25° C. for the results shown in FIG. 6A, and at 80° C. for the results shown in FIG. 6B. In FIGS. 6C and 6D, the composition was $[Na_{0.50}K_{0.50}(AlO_2)(SiO_2)]$ $wH_2O$, with the rheological study being conducted at 25° C. for the results shown in FIG. 6C and at 80° C. for the results shown in FIG. 6D. In FIGS. 6E and 6F, the composition was $[Na_{0.75}K_{0.25}(AlO_2)(SiO_2)]$ $wH_2O$, with the rheological study being conducted at 25° C. for the results shown in FIG. 6E and at 80° C. for the results shown in FIG. 6F.

Figure 7B:
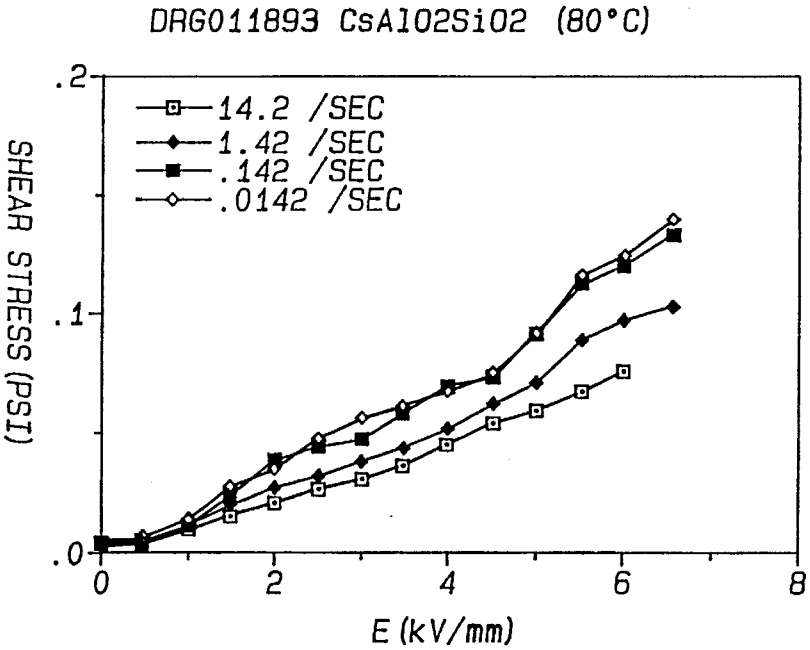
Figure 7A:
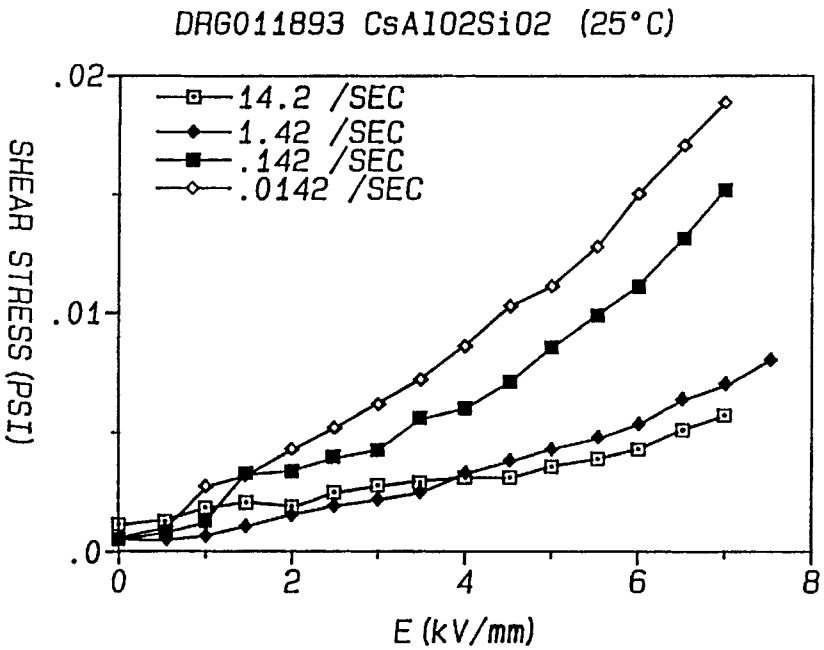

FIGS. 7A and 7B report the results of testing of an electrorheological fluid comprising 16 grams of amorphous, substantially water-free, cesium aluminosilicate $[Cs(AlO_2)(SiO_2)]$ $wH_2O$ powder dispersed in 30 ml of paraffin oil. For the results shown in FIG. 7A, the rheological study was conducted at 25° C. For the results shown in FIG. 7B the rheological study was conducted at 80° C.

Figure 8:
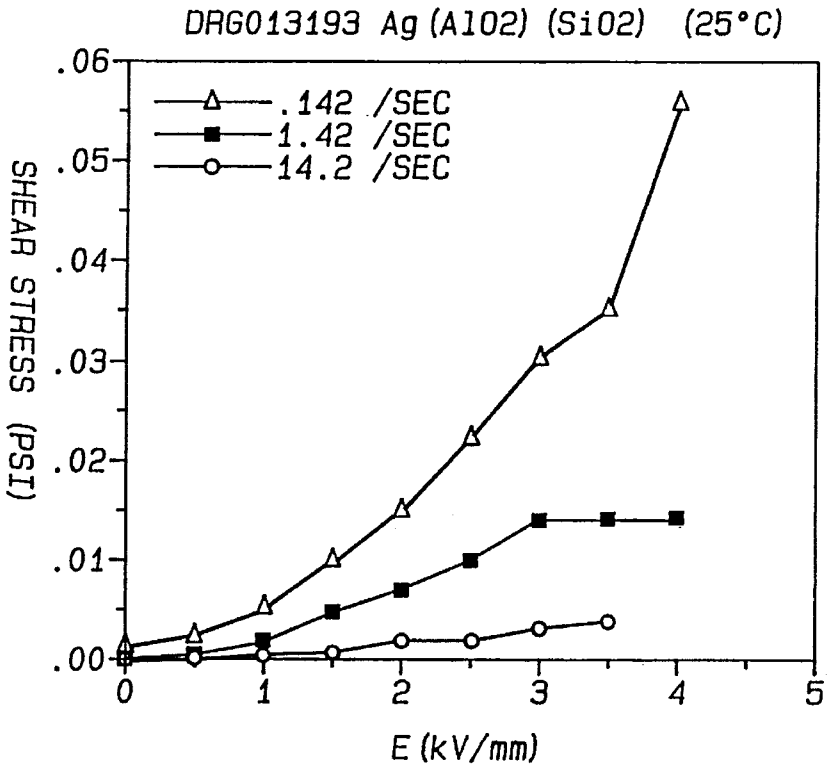

FIG. 8 represents the results of the testing of still another electrorheological fluid. It contained 11.8 grams of amorphous, substantially water-free, silver aluminosilicate, $[Ag(AlO_2)(SiO_2)]$ $wH_2O$ powder dispersed in 20 ml of paraffin oil. The study was conducted at 25° C.

Figure 9A:
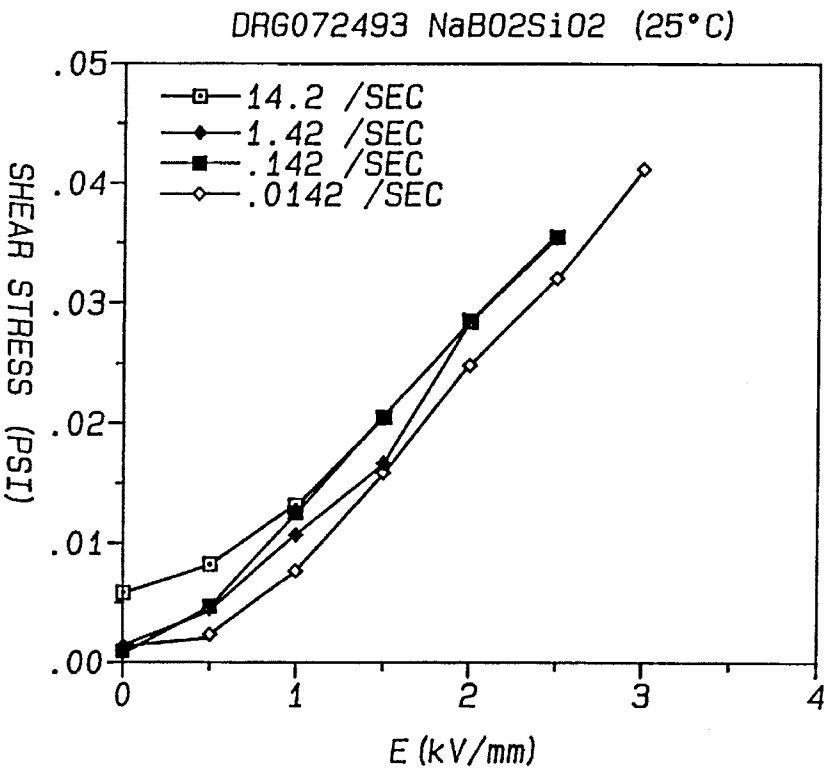
Figure 9B:
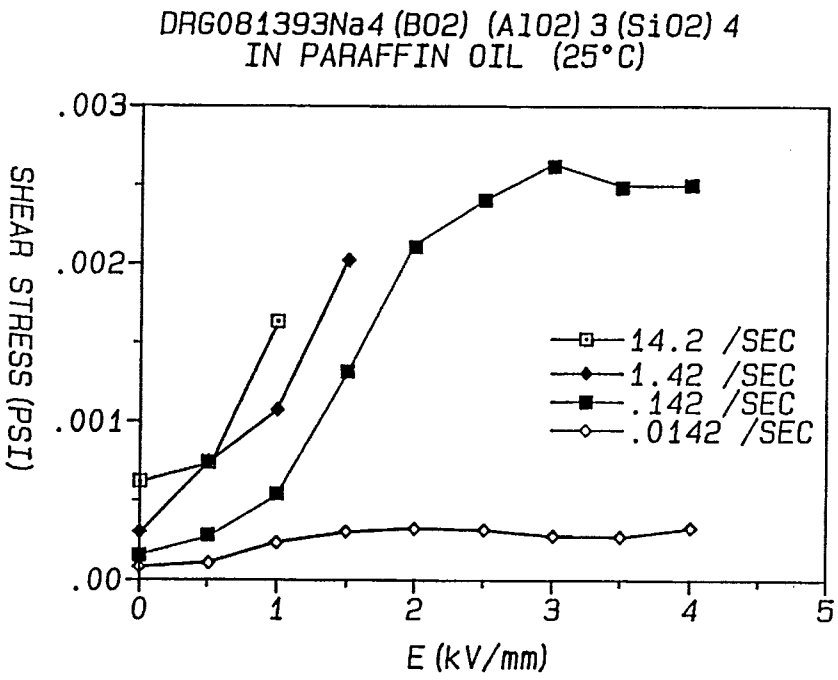

FIG. 9A represents the results of electrorheological testing of an electrorheological fluid of a still different composition. It contained 14 grams of amorphous, substantially water-free, sodium borosilicate $[Na(BO_2)(SiO_2)]$ $wH_2O$ powder dispersed in 30 ml of paraffin oil, with the rheological study being conducted at 25° C. FIG. 9B shows the results of electrorheological testing of a sample related to that of the FIG. 9A tests. However, it differs in that it is a boroaluminosilicate, instead of simply a borosilicate. The fluid providing the FIG. 9B test results was of an electrorheological fluid containing 14 grams of amorphous, substantially water-free, sodium boroaluminosilicate $[Na_4(BO_2)(AlO_2)_3(SiO_2)_4]$ $wH_2O$ powder dispersed in 30 ml of paraffin oil. The rheological testing was conducted at 25° C.

Figure 10:
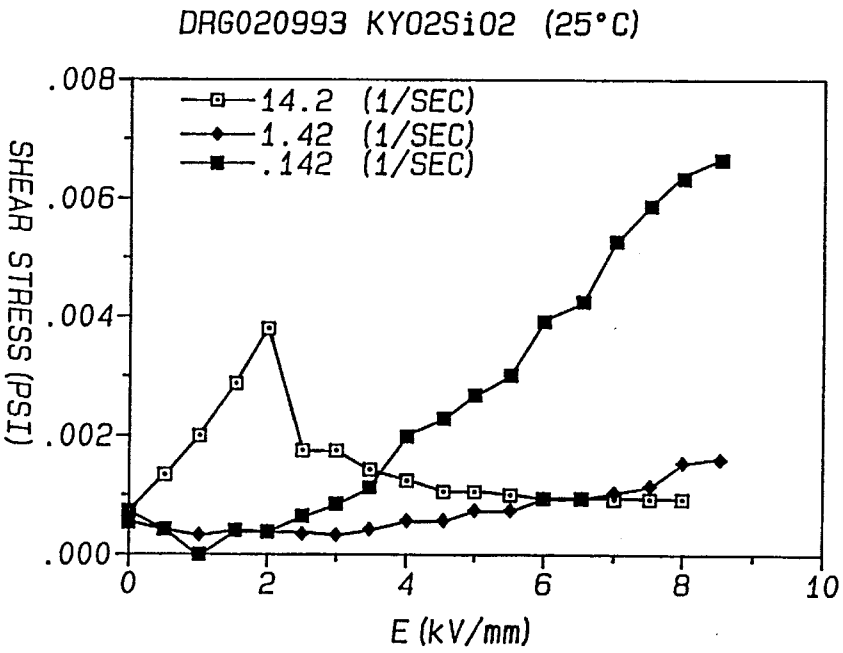

FIG. 10 shows the results of electrorheological testing of an electrorheological fluid comprising 14 grams of amorphous, substantially water-free, potassium yttriumsilicate $[K(YO_2)(SiO2)]$ $wH_2O$ powder dispersed in 30 ml of paraffin oil. The rheological study was conducted at 25° C.

It is recognized that the shear stress increase provided by some of our fluids under a given field, are not as high as those provided by others. For example, the fluids of FIGS. 8–10 are not particularly noteworthy in this latter respect when compared to the enhanced results shown in the FIG. 3A. On the other hand the compositions of FIGS. 7–10 are noteworthy in that they demonstrate the wide applicability of this invention. Also, we note that it appears that amorphous materials of all compositions appear to have a lesser tendency to absorb water than their crystalline counterparts, if they have one. Further, we believe that the examples provided herein amply demonstrate that many other amorphous, substantially water-free, ceramic powders can be used as a dispersed phase in an electrorheological fluid. It is believed that this invention opens the door to a wide variety of anhydrous amorphous ceramic powder/non-polar dielectric fluid combinations, many of which combinations may not even have been contemplated yet.

The foregoing detailed description shows that the preferred embodiments of the present invention are well suited to fulfill the objects above stated. It is recognized that those skilled in the art may make various modifications or additions to the preferred embodiments chosen to illustrate the present invention, without departing from the spirit and proper scope of the invention. For example, anhydrous amorphous ceramic materials of other compositions than disclosed herein made be found, as well as other techniques for producing the anhydrous amorphous ceramic particles. Accordingly to be understood that the protection sought and to be afforded hereby should be deemed to extend to the subject matter defined by the appended claims, including all fair equivalents thereof.

We claim:

1. An electrorheological fluid comprising:

an electrically nonconductive non-polar liquid phase; and a dispersed particulate phase of amorphous, substantially water-free, ceramic particles of a sodium-aluminosilicophosphate having the following chemical composition:

$$A_{(a/n)}D_{(d/m)}[(FOi)_x(GO_j)_y RO_k)_z]wH_2O$$

where:

A is principally sodium of valence charge n;

D is an anion of valence charge m; or is a mixture of anions of average valence charge m;

F is essentially aluminum;

G is essentially silicon;

R is essentially phosphorus;

O is essentially oxygen;

a and d are respective real number multipliers of A and D, provided that a cannot be zero; and i, j, k, x, y, and z each is any real number, not including zero and w is any low number resulting from two heat treatments of the amorphous material at a temperature of about 400 to 600 degrees Celsius for at least about five hours in each heat treatment.

2. An electrorheological fluid comprising: an electrically nonconductive non-polar phase; and a dispersed particulate phase of amorphous, substantially water-free, ceramic particles of silver-aluminosilicate.

3. An electrorheological fluid comprising: an electrically nonconductive non-polar phase; and a dispersed particulate phase of amorphous, substantially water-free, ceramic particles of potassium yttriumilicate.

4. An electrorheological fluid comprising: an electrically nonconductive non-polar phase; and a dispersed particulate phase of amorphous, substantially water-free, ceramic particles of potassium boroaluminosilicate.

5. An electrorheological fluid as defined in claim 1 wherein:

O includes minor proportions of at least one element selected from the class consisting of nitrogen and sulfur.

* * * * *

UNITED STATES PATENT AND TRADEMARK OFFICE

CERTIFICATE OF CORRECTION

PATENT NO. : 5,552,076

DATED : September 3, 1996

INVENTOR(S) : Gamota, et al

It is certified that error appears in the above-indentified patent and that said Letters Patent is hereby corrected as shown below:

Col 1, after the title, please insert the following --This invention was made in part with government support under Grant BCS-9201787 awarded by the National Science Foundation. The U.S. government retains certain rights in this invention.--

Signed and Sealed this

Second Day of December, 1997

*Attest:*

Bruce Lehman

BRUCE LEHMAN

*Attesting Officer*

*Commissioner of Patents and Trademarks*